US006042982A

United States Patent [19]

Hakata

[11] Patent Number: 6,042,982

[45] Date of Patent: Mar. 28, 2000

[54] ELECTROPHOTOGRAPHIC MAGNETIC CARRIER AND PROCESS FOR PRODUCING THE SAME

[75] Inventor: Toshiyuki Hakata, Hiroshima, Japan

[73] Assignee: Toda Kogyo Corporation, Japan

[21] Appl. No.: 09/109,071

[22] Filed: Jul. 2, 1998

[30] Foreign Application Priority Data

Jul. 4, 1997 [JP] Japan ..... 9-194988

[51] Int. Cl.[7] ..... G03G 9/113

[52] U.S. Cl. ..... 430/108; 430/106.6; 430/137

[58] Field of Search ..... 430/108, 106.6, 430/137

[56] References Cited

U.S. PATENT DOCUMENTS 4,822,708 4/1989 Machida et al. ..... 430/108

FOREIGN PATENT DOCUMENTS 0 384 697 8/1990 European Pat. Off. .
0 704 767 A1 4/1996 European Pat. Off. .
0 708 379 A2 4/1996 European Pat. Off. .
0 081 335 A1 10/1997 European Pat. Off. .
0 801 334 A1 10/1997 European Pat. Off. .

OTHER PUBLICATIONS

Grant, Roger et al. Grant and Hackh's Chemical Dictionary. New York: McGraw–Hill Inc. p. 529, 1987.

Diamond, Arthur S. (editor). Handbook of Imaging Materials. New York: Marcel–Dekker, Inc. pp. 222–223, 1991.

*Primary Examiner*—Christopher D. RoDee
*Attorney, Agent, or Firm*—Nixon & Vanderhye

[57] ABSTRACT

An electrophotographic magnetic carrier of the present invention has an average particle diameter of 10 to 300 $\mu$m and comprising a composite particle having a two-layered structure, comprises:

magnetic particle as a core particle;

a coating layer formed on the surface of the magnetic particle, comprising surface-treating agent having an amino group; and an outer layer formed on the surface of the surface-treating agent layer, comprising an inorganic material and a cured phenol resin, the ratio ($r_b/r_a$) of an average radius ($r_b$) of the core particle to a thickness ($r_a$) of the outer layer being in the range of 10:1 to 300:1.

The electrophotographic magnetic carrier not only has a high saturation magnetization and a freely controllable charge amount, but also is free from falling-off or separation of magnetic fine particles from a core particle.

20 Claims, 3 Drawing Sheets

(× 5000)

(× 5000)

(× 1200)

(× 5000)

ELECTROPHOTOGRAPHIC MAGNETIC CARRIER AND PROCESS FOR PRODUCING THE SAME

BACKGROUND OF THE INVENTION

The present invention relates to an electrophotographic magnetic carrier and a process for producing the magnetic carrier, and more particularly, to an electrophotographic magnetic carrier not only having a high saturation magnetization and a freely controllable charge amount, but also being free from falling-off or separation of magnetic fine particles from a core particle, for example, in case where a granulated particle comprising the magnetic fine particles is used as a core particle.

As is well known in the conventional electrophotographic processes, there has been adopted an image-developing method comprising using a photosensitive conductor formed of a photoconductive material such as selenium, OPC (organic photo-semiconductor) or amorphous silicone, forming an electrostatic latent image on the photosensitive conductor by various methods and electrostatically attaching to the latent image a toner charged to a polarity reverse to that of the latent image.

In such an image-developing method, there have been used particles called "a carrier" which is brought into frictional contact with a toner to impart an adequate amount of positive or negative charge to the toner. The thus charged toner is transported through a developing sleeve using a magnetic force exerted by a magnet accommodated in the developing sleeve, to a developing zone adjacent to a surface of the photosensitive conductor where the latent image is formed.

In recent years, the electrophotographic techniques have been widely applied to copying machines, printers or the like. In these applications, it has been required to accurately reproduce fine lines, small characters, photographs, color images or the like. Further, it have also been required to achieve a high-quality or high-grade image, a high-speed or continuous operation or the like. These demands are expected to be more and more increased in the future.

As conventional carriers, there have been used magnetic particles such as iron powder (a mechanically crushed iron powder, an electrolytic iron powder, a reduced iron powder, a heat-treated iron powder, a sintered iron powder or the like), ferrite particles (Mn ferrite particles, Li—Mn ferrite particles, Ni—Zn ferrite particles, Mn—Zn ferrite particles, Cu—Zn ferrite particles or the like) or magnetite particles or the like. However, any of these particles exert a large stress against toner due to an impact force therebetween when both are mixed and agitated together in a developing device, so that the developer suffers from deterioration in its durability during a long-term use.

In addition, irregularities on surfaces of magnetic particles causes the same problem concerning the durability of developer as mentioned above, especially when toner is deposited into concave portions thereof.

Further, in some methods of producing magnetic particles, there arises such an disadvantage that a large amount of fine particles having as small a diameter as not more than 1 $\mu$m are present therein. The fine particles tend to be fallen-off or separated from the surface of the magnetic particle which, for example, comprises magnetic fine particles, thereby causing such a problem that when the magnetic particles are mixed with a colored toner, the color tone of the toner is deteriorated. Especially, in the case of yellow-colored toner, the above-mentioned problem becomes more remarkable.

In order to solve these problems, there have been proposed resin-coated magnetic particles obtained by coating as a core particle a magnetic particle of a granulated particle comprising magnetic fine particles or iron powder (iron particle) with an insulating resin as a carrier. However, in the case where the granulated particle comprising the magnetic fine particles is coated with a resin in a large thickness to inhibit falling-off or separation of magnetic fine particles from the core particle, the volume resistivity of the carrier itself becomes too large, thereby causing such a problem that images having a deteriorated quality are produced, e.g., images showing too sharp edges or conversely solid images having too low toner density.

Further, when the core particle is coated with a resin, irregularities on the surface of each core particle are reflected on the surface of resin layer formed thereon, so that there is caused a so-called "spent" phenomenon that toner is deposited into concave portions thereof during a long-term operation. Thus, in the case of the resin-coated magnetic particles, the problem concerning the durability of developer still remains unsolved. Furthermore, the conventional resin-coated magnetic particles are deteriorated in adhesion between the core particle and the coating resin, thereby causing such a problem that the resin-coating layer is peeled-off or separated from the core particle during a long-term use.

In order to solve the former problem concerning the high volume resistivity, in Japanese Patent Applications Laid-open (KOKAI) Nos. 2-120750(1990) and 3-72372(1991), it has been proposed to incorporate a conductive material such as carbon black or metal oxides into the resin-coating layer. However, there still exist problems that the content of the conductive material in the resin-coating layer is insufficient to reduce the volume resistivity, and that the adhesion between the core particle and the resin-coating layer is unsatisfactory.

On the other hand, in order to solve the latter problem concerning the adhesion between the core particle and the resin-coating layer, in Japanese Patent Applications Laid-open (KOKAI) Nos. 64-29857(1989) and 62-121463(1987), there has been proposed methods of preliminarily surface-treating the core particle with a coupling agent such as a Si-based coupling agent, a Ti-based coupling agent or an Al-based coupling agent. In the case of using the method described in Japanese Patent Application Laid-open (KOKAI) No. 64-29857(1989), the resin-coating layer is constituted by thermoplastic resin polymer particles, thereby causing such a problem that when the resin-coated particles are mixed with toner in a developing device, there is caused a fusion therebetween. In the case of using the method described in Japanese Patent Application Laid-open (KOKAI) No. 62-121463(1987), no additives are contained in the resin-coating layer, thereby causing the above-mentioned problem concerning the electrical resistivity.

Also, in order to essentially solve these problems, there have been proposed a so-called resin carrier in which magnetic fine particles having a diameter of about 0.1 to about 2 $\mu$m are dispersed in an insulating resin.

Since the resin carrier has a light weight, the stress exerted against toner when agitated therewith in a developing device is small, so that a long life of developer can be assured.

However, since the resin carrier comprises about 30 to about 50% by weight of the insulating resin and the magnetic fine particles, the saturation magnetization of the carrier becomes low, thereby causing a so-called carrier adhesion, i.e., such a phenomenon that the carrier scattered from the magnet roll of the developing device during use, adheres to the surface of the photosensitive conductor. As a result, there arises a problem that voids are formed in obtained images. Therefore, it is required to recover the carrier from the surface of the photosensitive conductor or replenish the carrier in the developing device.

Especially in recent years, the toner has been required to have much smaller particle size, specifically in order to achieve a high image quality. For this reason, it has also been required to correspondingly reduce a particle size of the carrier itself. This results in decrease of magnetization per one carrier particle, so that the above-mentioned problems tend to be frequently caused.

In addition, the printing speed of recent copying machines or printers becomes considerably higher as compared to those of conventional ones. Specifically, in order to increase the printing speed, it is required to increase the developing speed. As a result, it is necessary to provide such a carrier which can be firmly retained on the developing sleeve even when the sleeve is rotated at a high speed. That is, the higher magnetization of the carrier is required.

As a result of the present inventors' earnest studies for solving the above-mentioned problems, it has been found that by treating the surface of a magnetic particle as a core particle with a surface-treating agent having an amino group to form a coating layer comprising surface-treating agent having an amino group, on surface of the magnetic particle, and reacting phenols with aldehydes in an aqueous solvent containing the above-treated magnetic particles, inorganic fine particles subjected to a pre-treatment for imparting a lipophilic property thereto in the presence of a basic catalyst to form an outer layer comprising inorganic fine particles and a cured phenol resin on a surface of the surface-treating agent layer, the produced composite particles are useful as an electrophotographic magnetic carrier. The present invention has been attained on the basis of this finding.

SUMMARY OF THE INVENTION

It is an object of the present invention to provide an electrophotographic magnetic carrier not only having a high saturation magnetization and a freely controllable charge amount, but also being free from falling-off or separation of magnetic fine particles from a core particle, in case where a granulated particle comprising the magnetic fine particles as a core particle.

To accomplish the aim, in a first aspect of the present invention, there is provided an electrophotographic magnetic carrier having an average particle diameter of 10 to 300 $\mu$m, comprising a composite particle having a two-layered structure, comprising (i) magnetic particle as a core particle, (ii) a coating layer formed on the surface of the magnetic particle, comprising surface-treating agent having an amino group, and (iii) an outer layer formed on the surface of the surface-treating agent layer, comprising an inorganic material and a cured phenol resin, the ratio ($r_b/r_a$) of an average radius ($r_b$) of the core particle to a thickness ($r_a$) of the outer layer being in the range of 10:1 to 300:1.

In a second aspect of the present invention, there is provided an electrophotographic magnetic carrier having an average particle diameter of 10 to 300 $\mu$m, comprising a composite particle having a three-layered structure, comprising (i) magnetic particle as a core particle, (ii) a coating layer formed on the surface of the magnetic particle, comprising surface-treating agent having an amino group, (iii) an outer layer formed on the surface of the surface-treating agent layer, comprising an inorganic material and a cured phenol resin, and (iv) a resin-coating layer formed on the surface of said outer layer, the ratio ($r_b/r_a$) of an average radius ($r_b$) of the core particle to a thickness ($r_a$) of the outer layer being in the range of 10:1 to 300:1.

In a third aspect of the present invention, there is provided a process for producing an electrophotographic magnetic carrier, comprising the steps of:

treating magnetic particles with a surface-treating agent containing an amino group to form a coating layer comprising surface-treating agent having an amino group on the surface of said magnetic particle, reacting phenols with aldehydes in an aqueous solvent containing the treated magnetic particles and inorganic fine particles subjected to a preliminary treatment for imparting a lipophilic property thereto in the presence of a basic catalyst, to form an outer layer comprising said inorganic fine particles and the cured phenol resin on a surface of the coating layer comprising surface-treating agent having an amino group.

DETAILED DESCRIPTION OF THE INVENTION

Figure 1:
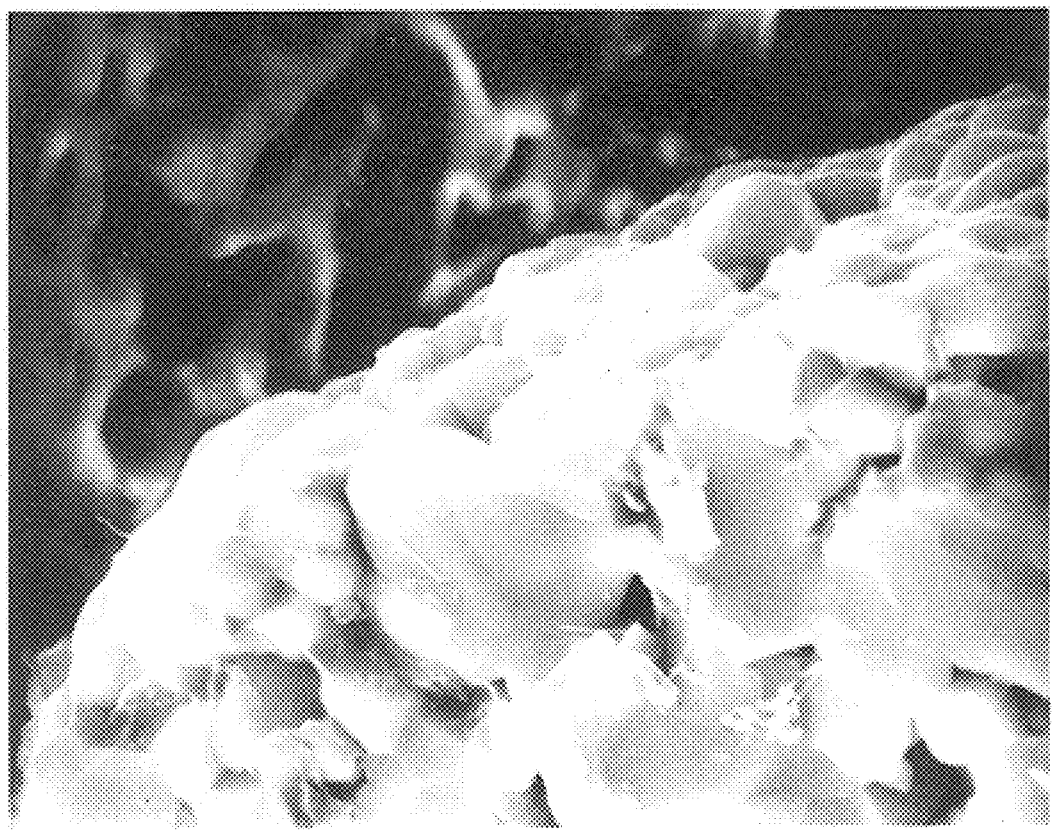
FIG. 1 is a scanning electron microscope photograph (×5,000) showing a cross-sectional particle structure of a Mn—Zn ferrite particle used as a core particle in an Example 1 of the present invention.

The present invention is explained in detail below.

First, the electrophotographic magnetic carrier according to the present invention is described.

The composite particles according to the present invention have an average particle diameter of usually 10 to 300 $\mu$m, preferably 10 to 200 $\mu$m. Especially, when it is intended to obtain an image having a high quality, the average particle diameter of the composite particles is preferably 20 to 200 $\mu$m, more preferably 30 to 100 $\mu$m. When the average particle diameter of the composite particles is less than 10 $\mu$m, the carrier adhesion to a photosensitive conductor tends to be caused. On the other hand, when the average particle diameter of the composite particles is more than 300 $\mu$m, it becomes difficult to obtain a clear image.

The composite particles according to the present invention may be of a granular shape, a spherical shape or the like. Among them, the composite particles having a spherical shape are preferred.

The composite particle according to the present invention has a two-layered structure on the surface of the core particle, and comprises a magnetic particle as a core particle, a coating layer comprising surface-treating agent having an amino group (hereinafter referred to simply as "surface-treating agent layer") and formed on the surface of the magnetic particle, and an outer layer comprising inorganic fine particles and a cured phenol resin and formed on the surface of the surface-treating agent layer. The ratio ($r_b/r_a$) of an average radius ($r_b$) of the core particle to a thickness ($r_a$) of the outer layer is usually in the range of 10:1 to 300:1, preferably 20:1 to 200:1.

Incidentally, the thickness of the surface-treating agent layer is extremely smaller as compared to the average radius of the core particle and the thickness of the outer layer, so that the above-mentioned ratio ($r_b/r_a$) is not influenced by the thickness of the surface-treating agent layer. That is, the amount of the surface-treating agent layer is preferably 0.05 to 1.0% by weight based on the weight of the core particle.

In the composite particles according to the present invention, the content of the inorganic fine particles in the outer layer is preferably 80 to 99% by weight based on the weight of the outer layer and the content of the cured phenol resin is preferably the balance.

In a further preferred embodiment of the present invention, the composite particle have a three-layered structure on the surface of the core particle, and comprises the magnetic particle as a core particle, the surface-treating agent layer formed on the surface of the magnetic particle, and the outer layer comprising inorganic fine particles and a cured phenol resin and formed on the surface of the surface-treating agent layer, and a resin-coating layer formed on the surface of the outer layer.

As the resins for the resin-coating layer, there may be used any known resins. Examples of the resins may include epoxy-based resins, silicone-based resins, polyester resins, fluorocarbon-based resins, styrene-based resins, phenol-based resins, silicon-based resins, melamine-based resins, polyamide resins or the like.

The amount of the resin-coating layer is usually 0.05 to 10% by weight, preferably 0.1 to 10% by weight, more preferably 0.2 to 5% by weight based on the weight of the composite particles to be coated, i.e., such composite particles before forming the resin-coating layer thereon. When the amount of the resin-coating layer is less than 0.05% by weight, insufficient and non-uniform coating layer may be formed, so that it may become difficult to obtain additional improvements or effects, for example, an effect of freely controlling a charge amount thereof. On the other hand, when the amount of the resin-coating layer is more than 10% by weight, the electrical resistivity of the resultant composite particles may become too high, thereby causing such a problem that the obtained image may has a deteriorated quality.

The true specific gravity of the composite particles according to the present invention is usually 3 to 7, preferably 4.5 to 5.5.

The composite particles according to the present invention may have a saturation magnetization of usually not less than 50 emu/g, preferably not less than 60 emu/g.

The fluidity of the composite particles according to the present invention is usually not more than 100 seconds, preferably not more than 80 seconds.

The percentage of change in charge amount of the composite particles according to the present invention is such that there exists substantially no difference in the charge amount between before and after the particles are subjected to a charge durability test.

As the magnetic particle used as a core particle in the present invention, there may be exemplified magnetic particles such as iron powder (a mechanically crushed iron powder, an electrolytic iron powder, a reduced iron powder, a heat-treated iron powder, a sintered iron powder or the like); metal oxides such as ferrite particles (Mn ferrite particles, Li—Mn ferrite particles, Ni—Zn ferrite particles, Mn—Zn ferrite particles, Cu—Zn ferrite particles or the like), magnetite particles, maghemite particles or the like; alloys or mixtures of these metals or metal oxides and other metals such as zinc or aluminum; mixtures of these metals or metal oxides and other metal oxides such as non-magnetic iron oxide; or mixtures thereof.

Among them, preferred magnetic particles are ferrite, maghemite, magnetite or the like.

The average particle diameter of the magnetic particle as a core particle is 9.98 to 270 μm, preferably 10 to 200 μm, more preferably 20 to 200 μm.

As the surface-treating agents having an amino group, there may be used amino-containing silane-based coupling agents, amino-containing titanate-based coupling agents, amino-containing aluminum-based coupling agents, amino-containing silicone oils, amino-containing surfactants or the like.

Among these surface-treating agents, from the viewpoint of adhesion to the core particles, the amino-containing silane-based coupling agents are preferred.

As the amino-containing silane-based coupling agents, there may be exemplified γ-aminopropyltriethoxy silane, N-β-(aminoehtyl)-γ-aminopropyltrimethoxy silane, N-β-(aminoehtyl)-γ-aminopropylmethyldimethoxy silane, N-phenyl-γ-aminopropyltrimethoxy silane or the like.

As the inorganic fine particles usable in the present invention, there may be exemplified iron oxides such as hematite, maghemite or magnetite; iron oxide hydroxides such as goethite; alumina; titanium oxide; zinc oxide; calcium carbonate; talc; silica; silicon dioxide; or the like.

The volume resistivity or chargeability of the composite particles according to the present invention may be controlled by selectively using the inorganic fine particles. More specifically, in the case where the positive chargeability is to be increased, alumina particles may be used as the inorganic fine particles. Conversely, in the case where the negative chargeability is to be increased, silica particles may be selectively used as the inorganic fine particles. In addition, in the case where the electrical resistivity is to be increased, hematite particles may be used as the inorganic fine particles. Conversely, in the case where the electrical resistivity is to be decreased, magnetite particles may be selectively used as the inorganic fine particles. Further, for the purpose of preventing the reduction of the saturation magnetization of the resultant composite particles, the magnetic iron oxides such as magnetite or maghemite are preferably used as the inorganic fine particles. Incidentally, if required, any two or more kinds of these inorganic fine particles may be used in combination.

The average particle diameter of the inorganic fine particles is usually 0.02 to 10 μm. In view of the dispersibility in an aqueous solvent and the strength of the composite particles produced, it is preferred that the average particle diameter of the inorganic fine particles is 0.05 to 5 μm. The inorganic fine particles may be of any shape such as a granular shape, a spherical shape, a needle-like shape or the like.

In the present invention, it is required that the inorganic fine particles are preliminarily subjected to a treatment for imparting a lipophilic property thereto.

As the method of conducting such a treatment for imparting a lipophilic property to the inorganic fine particles, there may be exemplified a method of treating the inorganic fine particles with a coupling agent such as a silane-based coupling agent, a titanium-based coupling agent or an aluminum-based coupling agent; a method of dispersing the inorganic fine particles in an aqueous solvent containing a surfactant to cause the surfactant to be adsorbed on the surfaces of the particles; or the like.

As the surfactants, there may be used commercially available surfactants. The preferred surfactants are those having functional groups capable of bonding with a hydroxyl group existing in the inorganic fine particles or on the surfaces thereof. With respect to ionicity, cationic or anionic surfactants are preferred.

Although the aim of the present invention can be accomplished by using any of the above-mentioned treating methods, in view of adhesion to the phenol resins, it is preferred that the inorganic fine particles be treated with such silane-based coupling agents having an amino group or an epoxy group.

As the phenols used in the present invention, there may be exemplified compounds having a phenolic hydroxyl group, for example, phenol; alkyl phenols such as m-cresol, p-tert-butyl phenol, o-propyl phenol, resorcinol or bisphenol A; halogenated phenols having chlorine atoms or bromine atoms substituted for a part or whole of hydrogen atoms bonded to a benzene ring or alkyl substituents of the phenols; or the like. Among these phenols, phenol is most preferred. In the case where compounds other than phenol are used as the phenols, it may be difficult to form particles, or even if particles are formed, the particles may be of an irregular shape. Therefore, in view of the shape of particles produced, phenol is most preferred.

As the aldehydes used in the present invention, there may be exemplified formaldehyde in the form of any of formalin or paraformaldehyde, furfural or the like. Among these aldehydes, formaldehyde is preferred.

Next, the process for producing the composite particles according to the present invention, is explained below.

First, in the process according to the present invention, it is necessary to treat the magnetic particle as a core particle with a surface-treating agent.

As the method of treating the magnetic particles with these surface-treating agents having an amino group, there may be used any ordinary methods, for example, a method of immersing the magnetic particles in a solution prepared by dissolving the surface-treating agent having an amino group in water or a solvent, followed by filtering and drying; a method of spraying an aqueous or solvent-based solution of the surface-treating agent on the magnetic particles while stirring the particles, followed by drying; or the like.

Next, the reaction of phenols with aldehydes in an aqueous solvent containing the above-treated magnetic particles, inorganic fine particles subjected to a pre-treatment for imparting a lipophilic property thereto is conducted in the presence of a basic catalyst to form an outer layer comprising inorganic fine particles and a cured phenol resin on a surface of the surface-treating agent layer.

The molar ratio of the aldehydes to the phenols is preferably 1:1 to 4:1, more preferably 1.2:1 to 3:1. When the molar ratio of the aldehydes to the phenols is less than 1:1, it may become difficult to form particles, or even if particles are formed, it is difficult to cure the resin, so that obtained particles tend to have a low mechanical strength. On the other hand, when the molar ratio of the aldehydes to the phenols is more than 4:1, there is a tendency that the amount of unreacted aldehydes remaining in the aqueous solvent is increased.

As the basic catalyst, there may be exemplified basic catalysts used for ordinary production of resorcinol resins. Examples of these basic catalysts may include ammonia water, hexamethylene tetramine, alkyl amines such as dimethyl amine, diethyl triamine or polyethylene imine, or the like.

The molar ratio of the basic catalyst to the phenols is preferably 0.02:1 to 0.3:1. When the molar ratio of the basic catalyst to the phenols is less than 0.02:1, the resin may not is sufficiently cured, resulting in unsatisfactory granulation of particles. On the other hand, when the molar ratio of the basic catalyst to the phenols is more than 0.3:1, the structure of the phenol resin may be adversely affected, also resulting in deteriorated granulation of particles, so that it becomes difficult to obtain aimed composite particles.

When the phenols and the aldehydes are reacted with each other in the presence of the basic catalyst, the amount of the inorganic fine particles being present in the reaction system is 75 to 99% by weight, preferably 78 to 99% by weight based on the total weight of the phenols and the aldehydes. Further, in view of the mechanical strength of the outer layer formed, the amount of the inorganic fine particles is more preferably 80 to 99% by weight based on the total weight of the phenols and the aldehydes.

In accordance with the present invention, the reaction between the phenols and the aldehydes is conducted in the aqueous solvent. In this case, the amount of the aqueous solvent charged may be controlled such that the solid concentration, e.g., carrier concentration, in the aqueous solvent is preferably 30 to 95% by weight, more preferably 40 to 80% by weight.

The reaction between the phenols and the aldehydes may be conducted by gradually heating a mixture of these compounds up to a reaction temperature of 70 to 90° C., preferably 83 to 87° C. at a temperature rise rate of 0.5 to 1.5° C./minute, preferably 0.8 to 1.2° C./minute while stirring and then reacting the resultant mixture at that temperature for 60 to 150 minutes to cause the curing of the phenol resin.

After the curing of the phenol resin, the reaction mixture is cooled to not more than 40° C., thereby obtaining a water dispersion containing composite particles. The obtained composite particles have a two-layered structure on the surface of the core particle and comprise magnetic particle as a core particle, the surface-treating agent layer and formed on surface of the magnetic particle, and an outer layer composed of inorganic fine particles and cured phenol resin and formed on the surface of the surface-treating agent layer.

Next, the obtained water dispersion was subjected to filtering, centrifugal separation and solid-liquid separation according to ordinary methods. The separated solid component is washed with water and then dried, thereby obtaining the aimed composite particles.

Meanwhile, if required, a resin-coating layer may be further formed on surface of the thus-obtained composite particle in order to improve the durability thereof and control the charge amount thereof.

The resin-coating layer may be formed by any known methods. For example, as the method of forming the resin-coating layer, there may be used a method of dry-mixing the composite particles and the resin together using a Henschel mixer, a high-speed mixer or the like; a method of immersing the composite particles in a resin-containing solvent; a method of spraying the resin on the composite particles using a spray drier; or the like.

In addition, as other methods for forming the resin-coating layer, there may be exemplified a method of coating the surfaces of the two-layered composite particles with a melamine resin by reacting melamines and aldehydes in an aqueous solvent containing the two-layered composite particles to be treated; a method of coating the surfaces of the two-layered composite particles with an acrylonitrile-based polymer by polymerizing a mixture of acrylonitrile and the other vinyl-based monomer in an aqueous solvent containing the two-layered composite particles to be treated; a method of coating the surfaces of the two-layered composite particles with a polyamide resin by anionic polymerization of lactams in an aqueous solvent containing the two-layered composite particles to be treated; or the like.

The most important feature of the present invention lies in that by forming the surface-treating agent layer on the surface of the magnetic particle as a core particle, it becomes possible to form the outer layer comprising inorganic fine particles and cured phenol resin on the surface of the coated particle.

The reason why the outer layer can be suitably formed on the magnetic particle by forming the surface-treating agent layer on the surface of the magnetic particle as a core particle, is considered as follows.

That is, it is considered that the amino group contained in the surface-treating agent which constitutes an intermediate coating layer, acts as a starting point for the reaction for the production of the phenol resin, i.e., exhibits a so-called anchor effect for the phenol resin. Consequently, it is considered that the phenol resin is cured over the surface of the surface-treating agent layer while incorporating the inorganic fine particles therein. On the other hand, in the case where the surface-treating agent which constitutes an intermediate coating layer, has no amino group, the mixture of the phenol resin and the inorganic fine particles are granulated into small particles independent of the magnetic particle as a core particle, as described in Comparative Example 3 hereinafter. Therefore, it is considered that the existence of the surface-treating agent layer is effective to form the outer layer.

By the formation of the outer layer comprising the inorganic fine particles and the cured phenol resin, it is possible to control various properties such as volume resistivity, chargeability or magnetic properties of the resultant composite particles according to a kind of developing system used.

In addition, since irregularities on the surfaces of the core particle can be buried and eliminated by forming the outer layer comprising the inorganic fine particles and the cured phenol resin thereover, the sphericity of the obtained composite particles can be enhanced. The enhanced sphericity of the composite particles results in not only improvement in fluidity thereof and increase in charging speed of toner, but also preventing the spent phenomenon that the toner is deposited in the concave portions thereof.

Further, the composite particles according to the present invention can exhibit an excellent adhesion between the core particle and the outer layer. Therefore, the outer layer can be prevented from being peeled-off or separated from the core particle during use.

Since the outer layer comprises the cured phenol resin in which the inorganic fine particles dispersed, it becomes possible to lessen the damage to toner and to prevent the spent phenomenon.

In addition, in the case where a resin-coating layer is further formed on the surface of the outer layer comprising the inorganic fine particles and phenol resin, it becomes possible to obtain additional improvements or effects, for example, it is possible to freely control the charge amount of the composite particles. Further, the resin-coating layer can function as a protecting layer of the outer layer, resulting in increasing the durability of the resultant composite particles.

The composite particles according to the present invention can have a high saturation magnetization and a freely controllable charge amount, and is free from falling-off or separation of magnetic fine particles from the core particle. Accordingly, the composite particles according to the present invention are useful as an electrophotographic magnetic carrier.

EXAMPLES

The present invention will now be described in more detail with reference to the following examples, but the present invention is not restricted to those examples and various modifications are possible within the scope of the invention.

In the following Examples and Comparative Examples, the average particle diameter of particles was measured by a laser diffraction-type granulometer (manufactured by HORIBA SEISAKUSHO CO., LTD.). In addition, the shape of particles was observed by a scanning electron microscope S-800 (manufactured by HITACHI LIMITED).

The saturation magnetization was measured at an external magnetic field of 10 kOe by a sample vibration-type magnetometer VSM-3S-15 (manufactured by TOEI KOGYO CO., LTD.).

The true specific gravity was measured by a multi-volume densitometer (manufactured by MICROMELITIX CO., LTD.).

The volume resistivity was measured by a high resistance meter 4329A (manufactured by YOKOGAWA HEWLETT PACKARD CO., LTD.).

The fluidity was expressed by a flow rate calculated by dividing the weight (50 g) of composite particles by a drop time (second) thereof, which drop time was measured by dropping the composite particles filled in a glass funnel (opening: 75ϕ; height: 75 mm; inner diameter of conical section: 6ϕ; length of straight pipe section: 30 mm) by applying a predetermined amount of vibration to the funnel.

The radius ($r_b$) of core particles of the composite particles and the thickness ($r_a$) of the outer layer comprising inorganic fine particles and cured phenol resin were obtained by the following method.

The scanning electron microscope photograph of cross-section of the composite particles was observed to measure an average thickness ($r_a$) of the outer layer containing inorganic fine particles. The radius ($r_b$) of the core particles was calculated from the thickness ($r_a$) and a previously obtained average particle diameter of the composite particles. The ratio ($r_b/r_a$) was obtained from these values ($r_a$) and ($r_b$).

The durability test of the composite particles having a resin-coating layer was conducted in the following manner.

That is, 50 g of the composite particles were filled in a 100 cc glass sampling bottle, which was then capped and shaken for 10 hours by using a paint conditioner (manufactured by RED DEVIL CO., LTD.). The charge amounts of respective samples of the composite particles were measured before and after being shaken.

The charge amount was obtained as follows. That is, using 200 mg of a mixture of 95 parts by weight of the composite particles and 5 parts by weight of toner (CLC-200 BLACK produced by CANON CO. LTD.), a value A ($\mu$C) was measured by a blow-off charge measuring apparatus MODEL TB-200 (manufactured by TOSHIBA CHEMICAL CO., LTD.). The charge amount was calculated as a value per one gram of the composite particles according to the following formula:

$$[A\times 1/(0.2\times 0.05)(\mu C/g)]$$

As recognized from the scanning electron microscope photograph (×5,000) of FIG. 1 showing a cross-sectional structure of particle, the Mn—Zn ferrite particles used as core particles had a large number of irregularities on the surface thereof.

Example 1

One kilogram of Mn—Zn ferrite particles having an average particle diameter of 60 μm were charged into a Henschel mixer and intimately agitated. Thereafter, 1.0 g of a silane-based coupling agent containing an amino group (KBM-602 produced by SHIN-ETSU KAGAKU CO., LTD.) was added to the ferrite particles, and the mixture was heated to about 100° C. and intimately mixed and stirred at that temperature for 30 minutes, thereby obtaining core particles coated with the coupling agent.

Similarly, one kilogram of spherical magnetite particles having an average particle diameter of 0.23 μm were charged into a Henschel mixer and intimately stirred. Thereafter, 10 g of a silane-based coupling agent (KBM-403 produced by SHIN-ETSU KAGAKU CO., LTD.) was added to the magnetite particles, and the mixture was treated in the same manner as described above, thereby obtaining inorganic fine particles coated with the coupling agent.

Separately, 5 g of phenol, 7 g of 37% formalin, 400 g of the above surface-treated core particles, 20 g of the inorganic fine particles subjected to the above treatment for imparting a lipophilic property thereto, 5 g of 25% ammonia water and 418 g of water were charged into an one-liter four-neck flask. The mixture was heated to 85° C. for 60 minutes while stirring and reacted at that temperature for 120 minutes to cure a resin component therein, thereby forming a phenol resin layer containing the inorganic fine particles, on the surface of the core particles.

Next, after the content of the flask was cooled to 30° C., 0.5 liter of water was added thereto. Thereafter, the supernatant was removed, and the obtained precipitate was washed with water and then dried by blowing air.

The resultant dry product was further dried under reduced pressure (not more than 5 mmHg) at a temperature of 150 to 180° C. to obtain composite particles.

Figure 2:
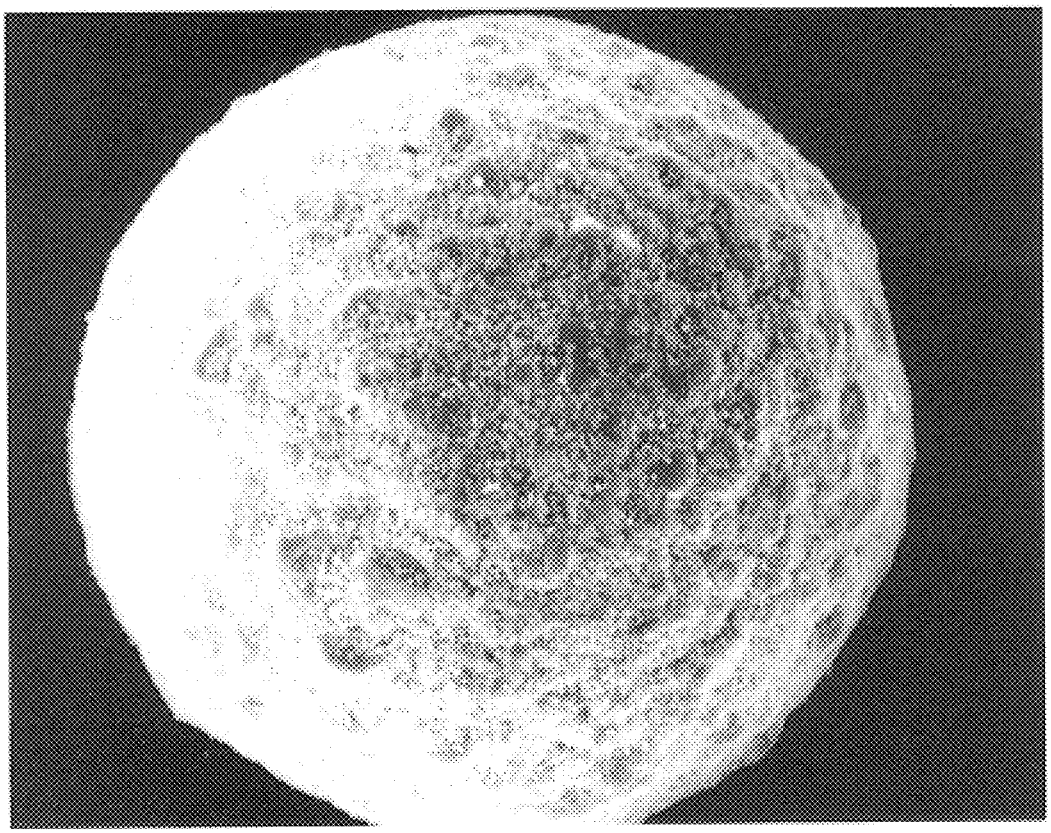
FIG. 2 is a scanning electron microscope photograph (×1,200) showing a particle structure of a spherical composite particle obtained according to the Example 1 of the present invention.
Figure 3:
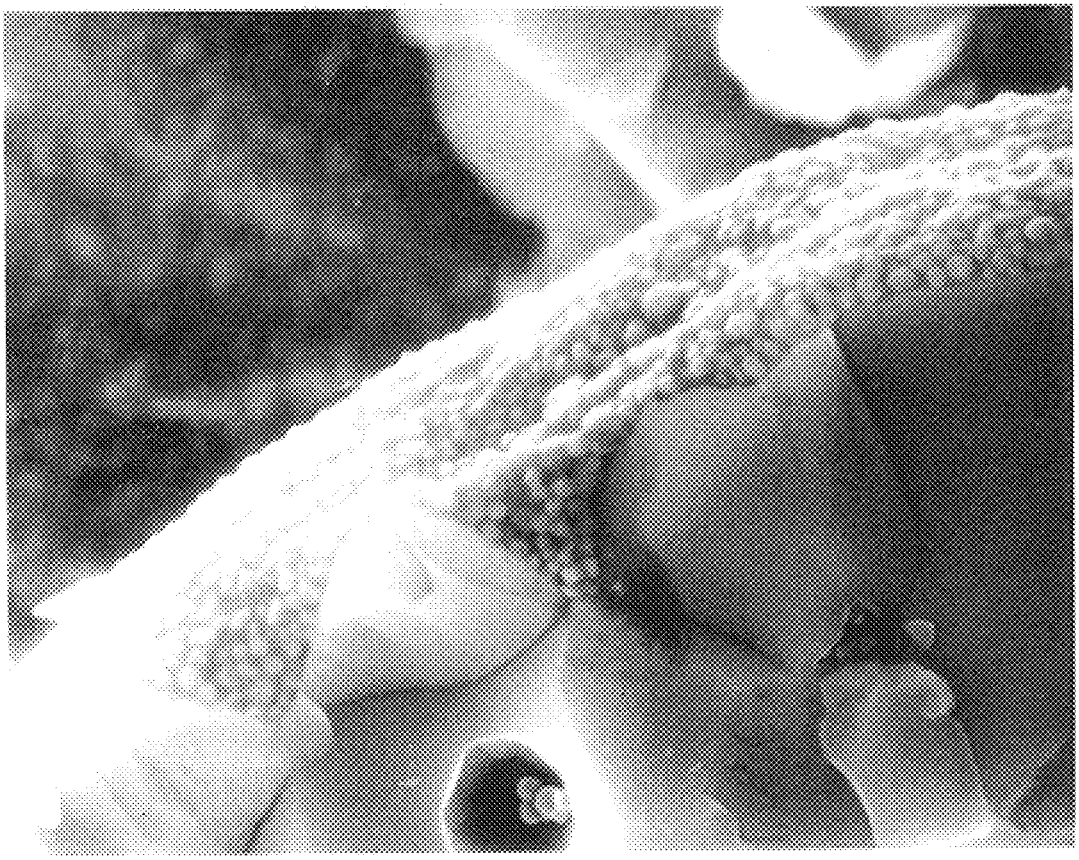
FIG. 3 is a scanning electron microscope photograph (×5,000) showing a cross-sectional particle structure of the spherical composite particle obtained according to the Example 1 of the present invention.

The average particle diameter of the thus obtained composite particles was 63 μm. As recognized from the scanning electron microscope photograph (×1,200) of FIG. 2, the obtained composite particles exhibited a high sphericity. Further, as recognized from the scanning electron microscope photograph (×5,000) of FIG. 3 showing a cross-sectional structure of the composite particle, the irregularities on the surface of the composite particle were buried and eliminated, so that the composite particle had a smooth surface.

It was also determined that the obtained composite particles exhibited excellent properties required for an electrophotographic developing carrier.

Specifically, the obtained composite particles had a specific gravity of 5.02, a fluidity of 25 seconds and a volume resistivity of $7\times 10^7$ Ωcm. In addition, it was determined that the total content of the magnetic particles (amount of a sum of Mn—Zn ferrite particles as core particles and spherical magnetite particles as magnetic inorganic fine particles based the total weight of the composite particles) was 98.9% by weight, and the content of the inorganic fine particles in the outer layer was 81% by weight based on the weight of the outer layer. With respect to magnetic properties of the obtained composite particles, the saturation magnetization thereof was 66.7 emu/g; the radius ($r_b$) of the core particles was 30 μm; the thickness ($r_a$) of the outer layer was 3 μm; and, therefore, the ratio ($r_b/r_a$) was 10. The amount of the surface-treating agent layer was 0.1% by weight based on the weight of the core particle.

<Production of composite particles>

Examples 2 to 5

The same procedure as defined in Example 1 was conducted except that kind of the core particles, kind and amount of the surface-treating agent used for the core particles, kind and amount of the inorganic fine particles, kind and amount of the treating agent for imparting a lipophilic property to the inorganic fine particles, amount of phenol, amount of formalin, amount of ammonia water as a basic catalyst and amount of water were varied, thereby producing composite particles. The production conditions are shown in Table 1 and various properties of the obtained composite particles are shown in Table 2.

Comparative Example 1

The same procedure as defined in Example 1 was conducted except that the core particles were subjected to no surface-treatment, the inorganic fine particles were not subjected to the treatment for imparting a lipophilic property thereto, and amount of phenol, amount of formalin, amount of water and amount of ammonia water as a basic catalyst were varied as shown in Table 1.

It was determined that the obtained product was a mixture of the core particles and separately granulated small particles composed of the inorganic fine particles and a phenol resin.

Comparative Example 2

The same procedure as defined in Example 1 was conducted except that the Mn—Zn ferrite core particles were subjected to no surface-treatment, and kind and amount of the inorganic fine particles, kind and amount of the treating agent for imparting a lipophilic property to the inorganic fine particles, amount of phenol, amount of formalin, amount of ammonia water as a basic catalyst and amount of water were varied as shown in Table 1.

It was determined that the obtained product was a mixture of the core particles and separately granulated small particles composed of the inorganic fine particles and a phenol resin.

Comparative Example 3

The same procedure as defined in Example 1 was conducted except that the Mn—Zn ferrite core particles were treated with a silane-based coupling agent containing no amino group, and kind and amount of the inorganic fine particles, kind and amount of the treating agent for imparting a lipophilic property to the inorganic fine particles, amount of phenol, amount of formalin, amount of ammonia water as a basic catalyst and amount of water were varied as shown in Table 1.

It was determined that the obtained product was a mixture of the core particles and separately granulated small particles composed of the inorganic fine particles and a phenol resin.

TABLE 1

| Examples and Comparative Examples | Production conditions of composite particles | | |
|---|---|---|---|
| | Core particles | | |
| | Kind | Average particle diameter ($2r_b$) $\mu$m) | Amount (g) |
| Example 2 | Ni—Zn ferrite | 70 | 400 |
| Example 3 | Mn—Zn ferrite | 100 | 400 |
| Example 4 | Magnetite | 50 | 400 |
| Example 5 | Cu—Zn ferrite | 60 | 400 |
| Comparative Example 1 | Mn—Zn ferrite | 80 | 400 |
| Comparative Example 2 | Mn—Zn ferrite | 80 | 400 |
| Comparative Example 3 | Mn—Zn ferrite | 80 | 400 |

| | Core particles Surface-treating agent | |
|---|---|---|
| | Kind | Amount applied (%) |
| Example 2 | Silane-based coupling agent (KBM-602 produced by SHIN-ETSU KAGAKU CO., LTD.) | 0.10 |
| Example 3 | Silane-based coupling agent (KBM-602 produced by SHIN-ETSU KAGAKU CO., LTD.) | 0.15 |
| Example 4 | Silane-based coupling agent (KBM-902 produced by SHIN-ETSU KAGAKU CO., LTD.) | 0.10 |
| Example 5 | Silane-based coupling agent (KBM-602 produced by SHIN-ETSU KAGAKU CO., LTD.) | 0.15 |
| Comparative Example 1 | — | 0 |
| Comparative Example 2 | — | 0 |
| Comparative Example 3 | Silane-based coupling agent (KBM-403 produced by SHIN-ETSU KAGAKU CO., LTD.) | 0.10 |

| | Conditions for formation of outer layer Inorganic fine particles | | | |
|---|---|---|---|---|
| | Kind | Amount | Treating agent for imparting lipophilic property | |
| | (particle diameter: $\mu$m) | Amount (g) | Kind | Amount treated (%) |
| Example 2 | Octahedral magnetite (0.30 $\mu$m) | 10 | Silane-based coupling agent (KBM-603 produced by SHIN-ETSU KAGAKU CO., LTD.) | 1.0 |
| Example 3 | Granular hematite (0.12 $\mu$m) | 6 | Silane-based coupling agent (KBM-402 produced by SHIN-ETSU KAGAKU CO., LTD.) | 1.5 |
| Example 4 | Granular titanium oxide (0.20 $\mu$m) | 2 | Silane-based coupling agent (KBM-403 produced by SHIN-ETSU KAGAKU CO., LTD.) | 2.0 |
| Example 5 | Spherical magnetite (0.2 $\mu$m) Plate-like alumina (0.5 $\mu$m) | 10 5 | Silane-based coupling agent (KBM-403 produced by SHIN-ETSU KAGAKU CO., LTD.) | 1.5 |
| Comparative Example 1 | Spherical magnetite (0.23 $\mu$m) | 10 | — | 0 |
| Comparative Example 2 | Spherical magnetite (0.23 $\mu$m) | 10 | Silane-based coupling agent (KBM-403 produced by SHIN-ETSU KAGAKU CO., LTD.) | 2.0 |
| Comparative Example 3 | Spherical magnetite (0.23 $\mu$m) | 10 | Silane-based coupling agent (KBM-403 produced by SHIN-ETSU KAGAKU CO., LTD.) | 0.8 |

| | Conditions for forming outer layer | | | | |
|---|---|---|---|---|---|
| | Amount of phenol (g) | Amount of 37 % formalin (g) | Basic catalyst Kind | Basic catalyst Amount (g) | Amount of water (g) |
| Example 2 | 3 | 4 | Ammonia water | 3 | 410 |
| Example 3 | 1.5 | 2 | Ammonia water | 1.5 | 404 |
| Example 4 | 1 | 1.5 | Ammonia water | 1 | 402 |
| Example 5 | 3 | 4 | Ammonia water | 3 | 420 |
| Comparative Example 1 | 3 | 4 | Ammonia water | 3 | 410 |
| Comparative Example 2 | 3 | 4 | Ammonia water | 3 | 410 |
| Comparative Example 3 | 3 | 4 | Ammonia water | 3 | 410 |

TABLE 2

| Examples and Comparative Examples | Properties of composite particles | | | |
|---|---|---|---|---|
| | Shape | Average particle diameter ($\mu$m) | Specific gravity | Fluidity (sec) |
| Example 2 | Spherical | 72 | 5.12 | 24 |
| Examp1e 3 | Spherical | 102 | 5.15 | 23 |
| Example 4 | Spherical | 51 | 5.14 | 28 |
| Example 5 | Spherical | 63 | 5.25 | 25 |
| Comparative Example 1 | Small particles were formed independent of core particles | | | |
| Comparative Example 2 | Small particles were formed independent of core particles | | | |
| Comparative Example 3 | Small particles were formed independent of core particles | | | |

| | Volume | Total content of magnetic | Content of inorganic fine particles in outer layer (based on total weight of |
|---|---|---|---|

TABLE 2-continued

| Examples and Comparative Examples | Properties of composite particles | | |
|---|---|---|---|
| | resistivity (Ωcm) | particles (wt. %) | outer layer (wt. %) |
| Example 2 | $3 \times 10^7$ | 99.5 | 82.9 |
| Example 3 | $7 \times 10^{12}$ | 98.2 | 81.8 |
| Example 4 | $2 \times 10^{12}$ | 99.4 | 82.8 |
| Example 5 | $5 \times 10^8$ | 99.0 | 88.7 |
| Comparative Example 1 | Small particles were formed independent of core particles | | |
| Comparative Example 2 | Small particles were formed independent of core particles | | |
| Comparative Example 3 | Small particles were formed independent of core particles | | |

| | Saturation magenetization σs (emu/g) | Radius ($r_b$) of core particles (μm) | Thickness ($r_a$) of outer layer (μm) | $r_b/r_a$ |
|---|---|---|---|---|
| Example 2 | 67.5 | 35 | 1.5 | 23 |
| Example 3 | 62.5 | 50 | 0.7 | 71 |
| Example 4 | 64.5 | 25 | 0.3 | 83 |
| Example 5 | 67.2 | 31 | 0.7 | 44 |
| Comparative Example 1 | Small particles were formed independent of core particles | | | |
| Comparative Example 2 | Small particles were formed independent of core particles | | | |
| Comparative Example 3 | Small particles were formed independent of core particles | | | |

<Formation of resin-coating layer>

Example 6

One kilogram of the composite particles obtained in Example 1 and 5 g (as a solid content) of a silicone resin (KR-251 produced by SHIN-ETSU KAGAKU CO., LTD.) were charged into a Henschel mixer under a nitrogen stream. The mixture was heated to 120° C. while agitating, and further agitated at that temperature for one hour, thereby forming a resin-coating layer composed of the silicone resin on the surfaces of the composite particles.

Various properties of the obtained composite particles having the resin-coating layer are shown in Table 3. It was determined that the surfaces of the particles were uniformly coated with the silicone resin.

Examples 7 to 10

The same procedure as defined in Example 6 was conducted except that kind of the composite particles used and kind and amount of the coating resin were varied, thereby producing composite particles having a resin-coating layer. The production conditions and various properties of the obtained composite particles are shown in Table 3.

Comparative Example 4

The same procedure as defined in Example 6 was conducted except that the Mn—Zn ferrite core particles obtained in Example 1 were used as particles to be resin-coated, instead of the composite particles, and the resin-coating layer was formed directly on the surfaces of the core particles.

Various properties of the obtained resin-coated Mn—Zn ferrite particles are shown in Table 3.

TABLE 3

| Examples and Comparative Examples | Conditions for forming resin-coating layer Particles to be resin-coated | |
|---|---|---|
| | Kind | Weight (kg) |
| Example 6 | Composite particles obtained in Example 1 | 1.0 |
| Examp1e 7 | Composite particles obtained in Example 1 | 1.0 |
| Example 8 | Composite particles obtained in Example 2 | 1.0 |
| Example 9 | Composite particles obtained in Example 3 | 1.0 |
| Example 10 | Composite particles obtained in Example 3 | 1.0 |
| Comparative Example 4 | Mn—Zn ferrite particles used as core particles in Example 1 | 1.0 |

| | Conditions for forming resin-coating layer Coating resin | |
|---|---|---|
| | Kind | Amount treated (%) |
| Example 6 | Silicone resin (KR-251 produced by SHIN-ETSU KAGAKU CO., LTD.) | 0.5 |
| Example 7 | Polyester resin (FC-022 produced by MITSUBISHI RAYON CO., LTD.) | 1.0 |
| Example 8 | Epoxy resin (EPICRON 850 produced by DAI-NIPPON INK CO., LTD.) | 0.8 |
| Example 9 | Styrene-based resin (BR-52 produced by MITSUBISHI RAYON CO., LTD.) | 1.5 |
| Example 10 | Fluorocarbon resin (KF POLYMER produced by KUREHA KAGAKU KOGYO CO., LTD.) | 0.7 |
| Comparative Example 4 | Silicone resin (KR-251 produced by SHIN-ETSU KAGAKU CO., LTD.) | 0.5 |

| | Properties of composite particles having resin-coating layer | | | | |
|---|---|---|---|---|---|
| | | | | Durability test | |
| | Amount of coating resin (wt. %) | Volume resistivity (Ωm) | Saturation magneti-zation (emu/g) | Charge amount before test (μC/g) | Charge amount after test (μC/g) |
| Example 6 | 0.4 | $7 \times 10^8$ | 66.4 | −25 | −23 |
| Example 7 | 0.9 | $5 \times 10^{12}$ | 65.7 | −35 | −35 |
| Example 8 | 0.8 | $8 \times 10^{11}$ | 67.1 | −30 | −31 |
| Example 9 | 1.4 | $4 \times 10^{15}$ | 62.0 | −45 | −42 |
| Example 10 | 0.5 | $2 \times 10^{10}$ | 62.3 | −42 | −42 |
| Comparative Example 4 | 0.4 | $8 \times 10^9$ | 66.8 | −27 | −5 |

What is claimed is:

1. An electrophotographic magnetic carrier having an average particle diameter of 10 to 300 μm and a true specific gravity of 3 to 7, and comprising a composite particle having a two-layered structure, said particle comprising:

magnetic particle as a core particle;

a coating layer formed on the surface of the magnetic particle, comprising a surface-treating agent having an amino group; and an outer layer formed on the surface of the surface-treating agent layer, comprising an inorganic material and a cured phenol resin, wherein the ratio ($r_b/r_a$) of an average radius ($r_b$) of the core particle to a thickness ($r_a$) of the outer layer being in the range of 10:1 to 300:1.

2. An electrophotographic magnetic carrier according to claim 1, wherein the content of said inorganic material in said outer layer is 80 to 99% by weight based on the weight of said outer layer.

3. An electrophotographic magnetic carrier according to claim 1, which has a saturation magnetization of not less than 50 emu/g.

4. An electrophotographic magnetic carrier according to claim 1, wherein the surface-treating agent is an amino-containing silane coupling agent, amino-containing titanate coupling agent, amino-containing aluminum coupling agent, amino-containing silicone oil or amino-containing surfactant.

5. An electrophotographic magnetic carrier according to claim 1, wherein said inorganic tine particles are iron oxide particles, iron oxide hydroxide particles, alumina particles, titanium oxide particles, zinc oxide particles, calcium carbonate particles, talc or silica.

6. An electrophotographic magnetic carrier according to claim 5, wherein said iron oxide particles are hematite particles, maghemite particles or magnetite particles and said iron oxide hydroxide particles are goethite particles.

7. An electrophotographic magnetic carrier according to claim 1, wherein the ratio ($r_b/r_a$) of an average radius ($r_b$) of the core particle to a thickness ($r_a$) of the outer layer being in the range of 20:1 to 200:1.

8. An electrophotographic magnetic carrier according to claim 1, which has a true specific gravity of 4.5 to 5.5 and a saturation magnetization of not less than 60 emu/g.

9. An electrophotographic magnetic carrier according to claim 1, wherein the amount of the surface-treating agent layer is 0.05 to 1.0% by weight based on the weight of the core particle.

10. A process for producing an electrophotographic magnetic carrier according to claim 1, comprising the steps of:

treating magnetic particles with a surface-treating agent containing an amino group to form a coating layer comprising surface-treating agent having an amino group on the surface of said magnetic particle, reacting phenols with aldehydes in an aqueous solvent containing the treated magnetic particles and inorganic fine particles subjected to a preliminary treatment for imparting a lipophilic property thereto in the presence of a basic catalyst, to form an outer layer comprising said inorganic fine particles and the cured phenol resin on a surface of the coating layer comprising surface-treating agent having an amino group.

11. An electrophotographic magnetic carrier having an average particle diameter of 10 to 300 $\mu$m and comprising a composite particle having a three-layered structure, said particle comprising:

magnetic particle as a core particle;

a coating layer formed on the surface of the magnetic particle comprising surface-treating agent having an amino group;

a layer formed on the surface of the surface-treating agent layer, comprising an inorganic material and a cured phenol resin; and a resin-coating layer formed on the surface of said cured phenol resin layer, wherein the ratio ($r_b/r_a$) of an average radius ($r_b$) of the core particle to a thickness ($r_a$) of the cured phenol resin layer being in the range of 10:1 to 300:1.

12. An electrophotographic magnetic carrier according to claim 11, wherein the amount of said resin-coating layer is 0.05 to 10% by weight based on the weight of said composite particles to be coated therewith.

13. An electrophotographic magnetic carrier according to claim 11, wherein said resin-coating layer comprises an epoxy resin, silicone resin, polyester resin, fluorocarbon resin, styrene resin, phenol resin, silicon resin, melamine resin or polyamide resin.

14. An electrophotographic magnetic carrier according to claim 11, wherein the content of said inorganic material in said cured phenol resin layer is 80 to 99% by weight based on the weight of said cured phenol resin layer.

15. An electrophotographic magnetic carrier according to claim 11, which has a saturation magnetization of not less than 50 emu/g.

16. An electrophotographic magnetic carrier according to claim 11, wherein the surface-treating agent is an amino-containing silane coupling agent, amino-containing titanate coupling agent, amino-containing aluminum coupling agent, amino-containing silicone oil or amino-containing surfactant.

17. An electrophotographic magnetic carrier according to claim 11, wherein said inorganic fine particles are iron oxide particles, iron oxide hydroxide particles, alumina particles, titanium oxide particles, zinc oxide particles, calcium carbonate particles, talc or silica.

18. An electrophotographic magnetic carrier according to claim 17, wherein said iron oxide particles are hematite particles, maghemite particles or magnetite particles and said iron oxide hydroxide particles are goethite particles.

19. An electrophotographic magnetic carrier according to claim 11, which has a true specific gravity of 4.5 to 5.5 and a saturation magnetization of not less than 60 emu/g.

20. An electrophotographic magnetic carrier according to claim 11, wherein the amount of the surface-treating agent layer is 0.05 to 1.0% by weight based on the weight of the core particle.

* * * * *